United States Patent [19]

Abatemarco

[11] Patent Number: 4,641,429

[45] Date of Patent: Feb. 10, 1987

[54] RAZOR BLADE CARTRIDGE UNIT WITH DUAL BLADES

[76] Inventor: Michael R. Abatemarco, P.O. Box 17252, Fountain Hills, Ariz. 85268

[21] Appl. No.: 685,490

[22] Filed: Dec. 24, 1984

[51] Int. Cl.[4] ..... B26B 19/14

[52] U.S. Cl. ..... 30/41; 30/50; 30/75; 30/84

[58] Field of Search ..... 30/47, 50, 75, 84, 41

[56] References Cited

U.S. PATENT DOCUMENTS

| | | | |
|---|---|---|---|
| 1,852,708 | 4/1932 | Stuart . | |
| 1,938,481 | 12/1933 | Black | 30/12 |
| 2,319,980 | 5/1943 | Des Jardins | 30/50 |
| 2,705,365 | 4/1955 | Van Heest | 30/41 |
| 3,660,893 | 5/1972 | Welsh | 30/50 |
| 3,724,070 | 4/1973 | Dorion, Jr. | 30/47 |
| 3,768,162 | 10/1973 | Perry | 30/47 |
| 3,783,510 | 1/1974 | Dawidowicz | 30/32 |
| 3,786,563 | 1/1974 | Dorion, Jr. | 30/50 |
| 3,972,114 | 8/1976 | Chao et al. | 30/41 |
| 4,047,296 | 9/1977 | Ishida et al. | 30/41 |
| 4,300,285 | 11/1981 | Endo | 30/41 |
| 4,344,227 | 8/1982 | Chen et al. | 30/41 |
| 4,535,537 | 8/1985 | Ferraro et al. | 30/41 X |

*Primary Examiner*—E. R. Kazenske
*Assistant Examiner*—Willmon Fridie, Jr.
*Attorney, Agent, or Firm*—LaValle D. Ptak

[57] ABSTRACT

A razor blade unit has a pair of single edged blades mounted between a base member and a cap member with a spacer between them. The spacer has fingers extending forwardly from a spine located to the rear of the blades to define channels between the fingers. These channels cooperate with holes at the rear of the unit and additional holes passing through the base member and the cap member to facilitate the removal of shaving residue from between the cutting edges of the blades. Additional holes communicating with the channels in the spacer are provided in each end of the razor blade unit to permit rinsing of the residue from the holes and from between the blades by applying water through these end holes.

9 Claims, 7 Drawing Figures

RAZOR BLADE CARTRIDGE UNIT WITH DUAL BLADES

BACKGROUND OF THE INVENTION

Safety razors of the type having a pair of tandemly mounted blades permanently mounted in a disposable cartridge are becoming increasingly popular. In such cartridges the blades are separated by a spacer, and the cutting edge of the upper blade is spaced slightly rearwardly of the cutting edge of the lower blade. A construction of such razor blade assemblies which is currently commercially popular is disclosed in the patent to Dorion, Jr., U.S. Pat. No. 3,724,070. Other disposable dual blade cartridges of the general type disclosed in the Dorion patent also are known, but the general construction and arrangements are similar to that disclosed in the Dorion patent. Such constructions, for example, are shown in the Perry patent, U.S. Pat. No. 3,768,162, and the Dorion et al patent, U.S. Pat. No. 3,786,563.

A problem which exists with dual blade disposable cartridges of the type disclosed in the above-mentioned patents is that the space between the tandemly mounted blades quickly becomes filled with hair and shaving residue since there is no provision for passing this residue from between the blades. The spacer blocks such passage. The spacer, however, is necessary because the blades are extremely thin and are not capable of maintaining the uniform space between them without the aid of a spacer. To overcome the problem of the accumulation of shaving residue, mechanical cleaning devices or movable spacers have been proposed. One such proposal is shown in the patent to Chao, et al, U.S. Pat. No. 3,972,114, which employs a reciprocating toothed spacer between the blades; so that the user may impart manual reciprocatory motion to the spacer as the cartridge is washed. A similar approach, using a mechanical movable spacer, is commercially available where the spacer is spring biased to a position just rearwardly of the cutting edge of the upper blade and may be manually moved forwardly against the bias of the spring to push the residue to a position generally overlying the cutting edge of the lower blade. In this position, the residue then may be washed away by the user. Such a device is disclosed in the patent to Ishida, U.S. Pat. No. 4,047,296. Both of these mechanical structures, however, require moving parts bvetween the blades; so that a tight bonded engagement of the blades with the spacer is not possible in the cartridge construction. Furthermore, it is necessary for the user to engage the cartridge and manually manipulate the spacer in some way or another during the rinsing action in order to remove the residue.

A relatively open dual blade construction for a safety razor is disclosed in the patent to Welsh, U.S. Pat. No. 3,660,893. The blades in this razor, however, are secured by the ends only and are placed under tension longitudinally of the cutting edges of the blades. When very thin blades are employed, which is the ideal condition for optimum shaving results, maintenance of the desired spacing between the two blades using the construction of this patent is difficult. A more rigid cartridge construction is desirable.

Another approach to providing some means for removing the residue from between the blades of a dual blade razor cartridge is shown in the Dawidowicz, et al patent, U.S. Pat. No. 3,783,510. The system shown in this patent has a spacer which includes channels in it to provide flow paths for shaving residue from between the cutting edges of the tandemly mounted blades. At the rear of the cartridge, a number of slots are provided; so that the residue can flow through the space and out the slots. A problem which exists in the structure of the Dawidowicz cartridge, however, is that the exit slots at the rear of the cartridge which communicate with the channels in the spacer necessarily are restricted in size. Consequently, the Dawidowicz cartridge, while it theoretically should be capable of cleaning out the residue from between the blades, as a practical matter still results in a construction where such cleaning is difficult to accomplish effectively.

Prior art solutions for cleaning single blade razors with replaceable blades in which the head is loosened for the cleaning operation are not applicable to disposable multiple-head cartridges in which the blades are not loosened or replaced.

Accordingly, it is desirable to provide a disposable razor blade cartridge unit employing tandemly mounted dual blades in which a provision is incorporated for readily and easily cleaning out the residue between the blades which accumulates during the use of the razor, without requiring partial disassembly of the cartridge, without requiring movable mechanical parts, and which overcomes the disadvantages of the various prior art devices discussed above.

SUMMARY OF THE INVENTION

Accordingly, it is an object of this invention to provide a multi-blade razor blade unit which facilitates cleaning the area between the blades following use.

It is another object of this invention to provide a multiple blade razor unit in which residue which accumulates between the blades during use may be rinsed therefrom without requiring any moving parts.

It is an additional object of this invention to provide a multiple blade cartridge for a razor which readily may be cleaned without requiring partial disassembly of the cartridge.

It is a further object of this invention to provide an improved structure of a multiple blade razor cartridge to facilitate cleaning of residue from between the blades.

In accordance with a preferred embodiment of this invention, a razor blade unit comprises a base member for supporting a first blade. The base member has a guard portion spaced from it to define a slot between the guard portion and the main body of the base member. The first blade is located on the base member with its cutting edge above the slot and extending parallel to the guard portion. A spacer, which has a plurality of fingers extending from a spine member, overlies the first blade; so that channels formed between the fingers extend beyond the rear edge of the first blade. A second blade then is placed on top of the spacer, and the spine of the spacer also extends beyond the rearmost edge of the second blade to expose the channels. A cap then is placed on top of the second blade and is attached to the base member to clamp the entire assembly together. Slots are formed in the cap member to the rear of the rear edge of the second blade and communicate with the channels in the spacer member to permit residue to be flushed through the channels and out of the slots. In addition, slots are formed between the cap and the base member at the rear of the assembly, so that residue may be flushed through these slots also.

In a more specific embodiment, additional slots are formed in the base member to the rear of the lower blade and communicate with the slots to provide yet another path for removing residue from between the blades. In another embodiment, the slot defined between the guard portion and the main body of the base member is oriented with corresponding slots in the cap member to permit residue to be flushed through the base member and the cap member and through holes in each of the blades for an additional path for removing residue from between the blades.

DETAILED DESCRIPTION

Figure 1:
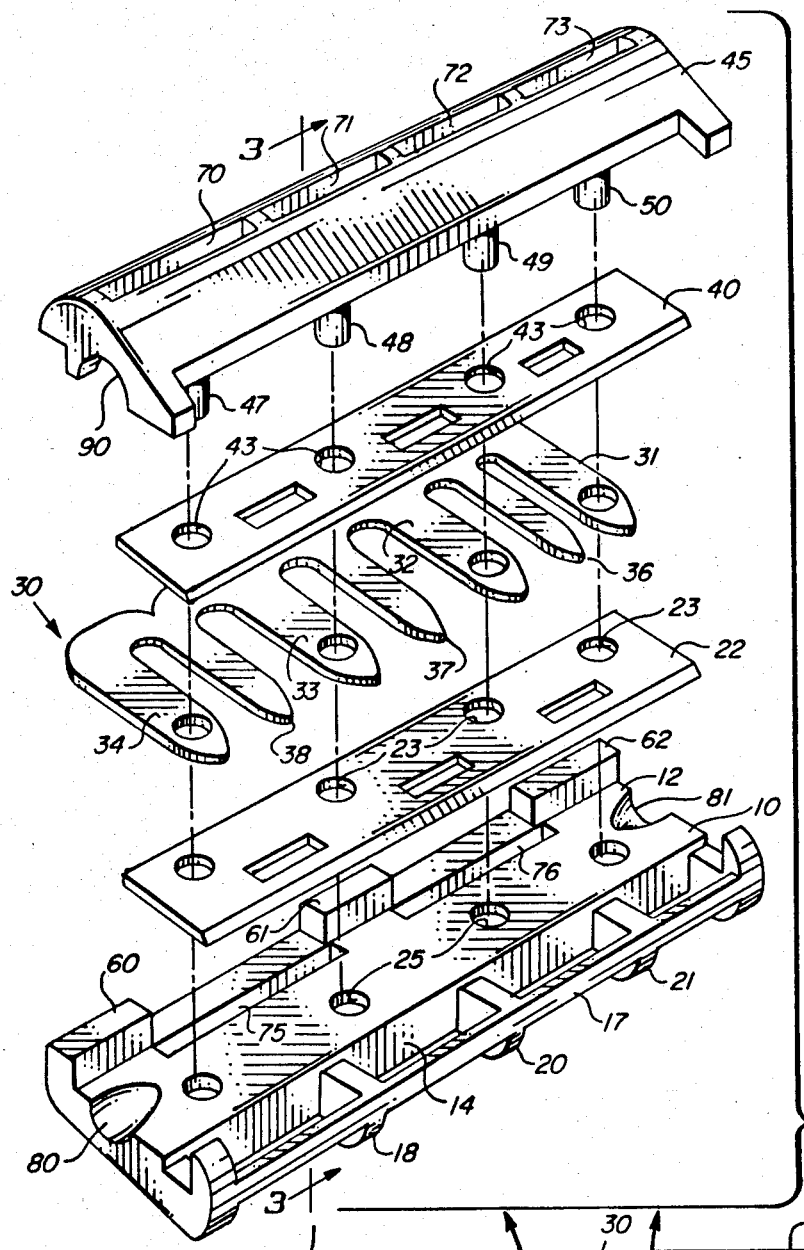
FIG. 1 is an exploded perspective view of a preferred embodiment of the invention.

In the various Figures of the drawings, the same reference numbers are used for the same or similar components. Reference first should be made to FIG. 1, which illustrates the various components of a cartridge type razor blade assembly.

The base member 10 forming the bottom of the disposable razor blade cartridge unit has end walls 11 and 12 and front and rear walls 14 and 15, respectively. The end walls extend forwardly beyond the front wall 14 and are further interconnected by a guard member 17 which extends parallel to, but is spaced from, the front wall 14 to form an open slot between the guard member and the front wall 14 of the base member 10. Three intermediate supports, 18, 20 and 21, extend from the front wall 14 of the base member 10 to the guard member 17 to maintain its spaced relationship and provide structural rigidity. As shown most clearly in FIG. 1, the members 18, 20 and 21 are arranged so that the upper surfaces of these members are below the upper surface of the blade support surface of the base member 10.

A first and lower single-edged planar razor blade 22 is placed on the support surface of the base member 10, with four mounting holes 23 passing through the blade 22 aligned with corresponding holes 25 formed through the base member 10. A comb-like spacer 30 is placed on top of the blade 22 and four fingers, 31 through 34, which have mounting holes located near their extreme ends, are located so that the mounting holes through these fingers are in alignment with the mounting holes 23 in the blade 22.

Figure 2:
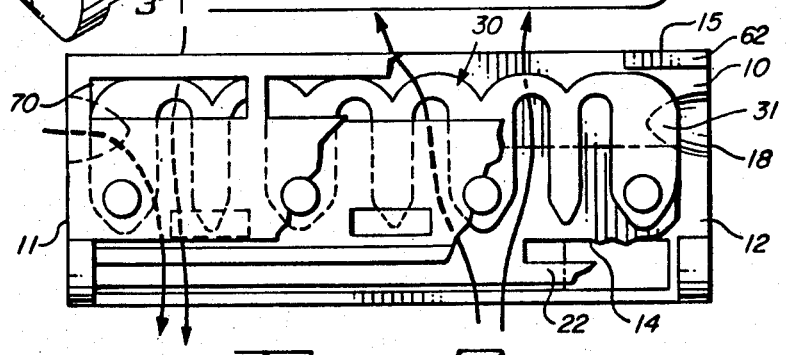
FIG. 2 is a partially cut-away top view of the assembly shown in FIG. 1.
Figure 3:
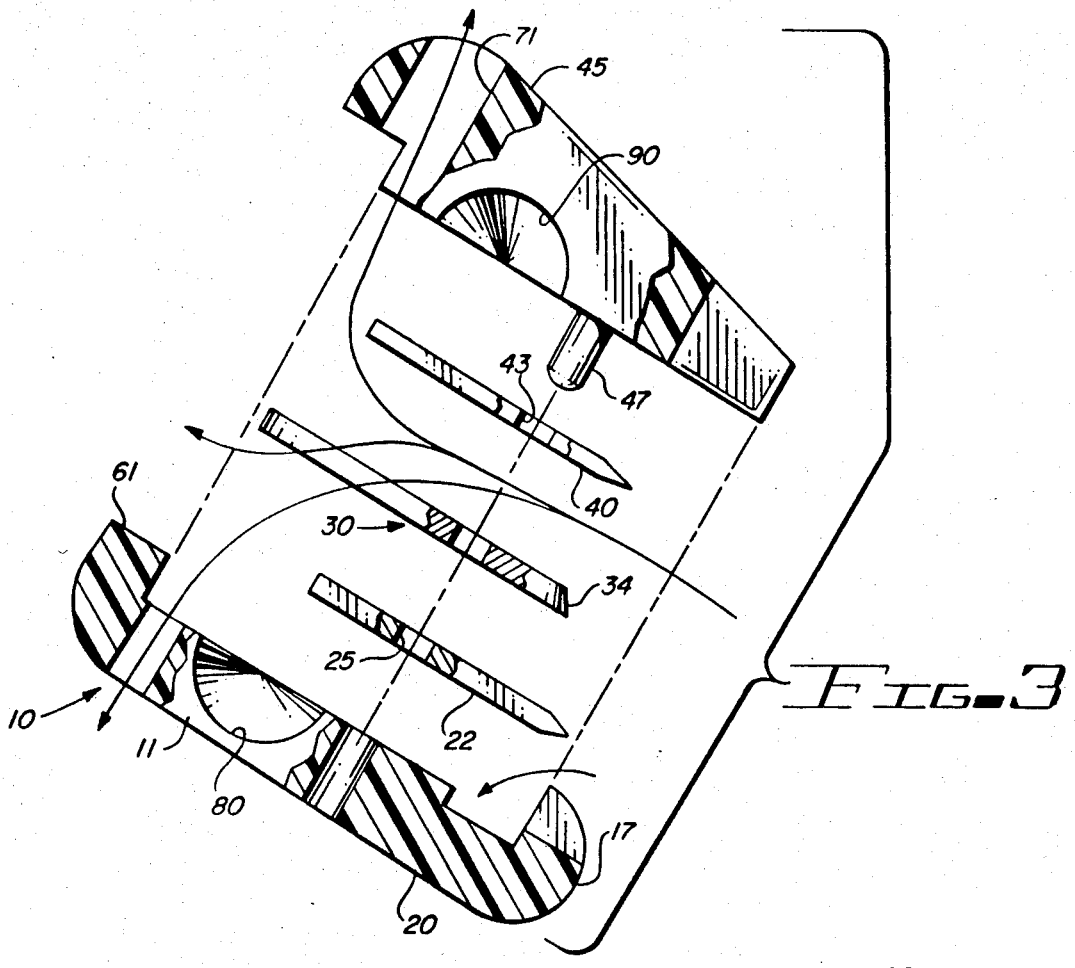
FIG. 3 is an exploded end view of the assembly shown in FIG. 1.

From a reference to FIGS. 1, 2 and 3, it is seen that the spine of the comb-like spacer 30 is located beyond the rear-most edge of the blade 22; so that the slots which are formed between the fingers 31 through 34 and intermediate support fingers 36E through 38 extend beyond the rear of the blade 22. FIGS. 2 and 3 show this most clearly.

Next in forming the razor blade cartridge unit, a second or upper blade 40 is placed on top of the spacer 30. The blade 40 has locating holes 43 in it, and these holes are aligned with the holes in the fingers 31 through 34 and the holes 23 in the lower blade 22 to establish the location of the upper blade slightly to the rear of the lower blade 22, as shown most clearly in FIGS. 2 and 3. The rear-most edge of the upper blade 40 also is located so that the slots in the spacer 30 extend beyond this edge for a purpose explained more fully subsequently.

The assembly is completed by placing a cap member 45 over the top of the entire assembly. The cap member 45 has circular projections 47, 48, 49 and 50 extending downwardly from it in alignment with the holes 43 in the top blade 40, the holes in the fingers 31 through 34, the holes 23 in the bottom blade 22, and finally, the holes 25 in the base member 10. These projections serve to hold and align all of the various parts together in the completed assembly shown in FIG. 2. Ideally, the attachment of the cap 45 to the base 10 is a permanent attachment either by providing a force fit of the projections 47 through 50 in the holes 25 or by cementing or otherwise bonding the parts together. The cartridge is not intended to be partially or fully disassembled once it has been manufactured. It is to be thrown away and replaced when the blades 22 and 40 become dull. The relationship of the various parts and their alignment with respect to the spacer 30 is illustrated most clearly in FIGS. 2 and 3.

The construction of the spacer 30 is for the purpose of permitting the flushing of shaving accumulations in the form of hair and soap from between the blades 22 and 40. The flush of residue from beneath the lower blade 22 is readily accomplished through the slot formed between the guard 17 and the front wall 14 of the base member in a conventional fashion. The relatively narrow space between the two blades 22 and 40, however, rapidly fills up with shaving accumulation; so that rinsing of this accumulation from between the blades for effective utilization of the second blade 40 in a shaving operation is necessary. To accomplish this, the assembly is constructed so that after it is clamped together, a pair of relatively wide slots or exit ports are formed at the rear of the cartridge between three support pillars, 60, 61 and 62, which engage the lower edge of the cap 45. This permits shaving residue to be flushed from the channels formed between the fingers of the spacer 30 and out of the rear of the cartridge. This space is relatively narrow; so that in the absence of additional ports or slots, it is possible that the vertical end surfaces of the spacer 30, where the fingers attach to the spine, could accumulate shaving residue and impede the flow of the residue outwardly through the slots in the rear of the cartridge.

To prevent this from happening and to facilitate the rapid and complete cleaning of the residue, four slots 70, 71, 72 and 73 are formed through the cap 45 near its rear-edge and overlying the rear ends of the channels between the fingers of the spacer 30, as seen most clearly in FIG. 2. Similarly, a pair of slots 75 and 76 are formed through the base member 10 in alignment with the slots 70 and 73 in the cap 45 to permit residue to be flushed downwardly through the base also. Consequently, any residue which might become lodged in the ends of the channels between the fingers of the spacer 30 may be readily dislodged by rinsing through the slots in the cap 45 and the base member 10. This permits a "flow through" area where residue can be flushed through rear or front as the razor is cleaned off every so often between shaving strokes or if the razor is rinsed out from the front or top.

To further provide a maximum effectiveness in the cleaning of residue from between the blades, a pair of end channels in the form of cone-like depressions 80 and 81 in the base member 10 and mating depressions 90 and 91 in the cap 45 permit the entry and exit of water and/or residue to pass between the blades 22 and 40 and laterally across the channels formed between the fingers of the spacer 30. These end channels open even further with adjustable blades currently being marketed.

By use of the construction which is described above and which is illustrated in FIGS. 1, 2 and 3 of the drawings, cleansing of shaving accumulations from between the blades of the dual blade cartridge readily may be effected without the necessity of utilizing any moving mechanical parts. The flushing out of the residue may be accomplished by rapidly moving the shaving cartridge back and forth in any direction in the water or by directing a flow of water from the tap into the space between the blades from the cutting edge side or through any of the various slots formed in the ends, top, bottom and sides of cartridge assembly illustrated.

In actual practice, the utilization of a flow of water to flush residue from between the blades generally is effected from several directions, so that accumulations which may not be dislodged by a water flow in one direction will be dislodged by a water flow in some other direction. The construction which is shown makes this possible since the various slots and depressions which are employed permit such flow from multiple directions. As a consequence, maximum effectiveness in the cleaning of residue from between the blades is accomplished with a structure which is no more costly to produce and assemble than conventional dual blade cartridges presently commercially available on the market. The improved operating results and the shaving effectiveness which is achieved is highly desirable.

Figure 4:
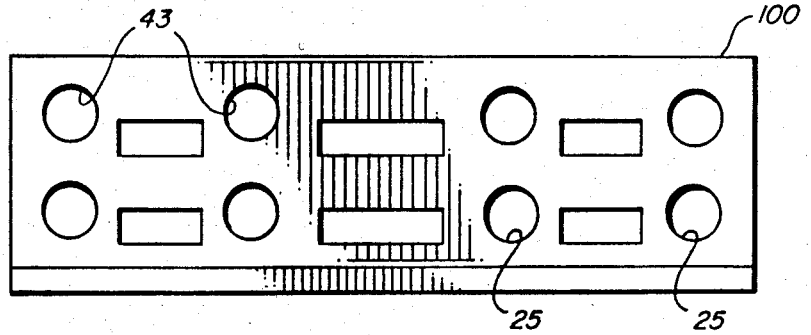
FIG. 4 shows an alternative construction of a blade which may be employed in the assembly shown in FIGS. 1, 2 and 3.

FIG. 4 illustrates an alternative form of a blade 100 which may be universally used for both the upper and lower blades 22 and 40 in place of the two different blades illustrated in FIGS. 1, 2 and 3. The universal blade shown in FIG. 4 is of the same general construction as the blades 22 and 40 except that it has a slightly greater front to back width or depth than either of the blades 22 and 40 shown in FIGS. 1, 2 and 3.

Figure 5:
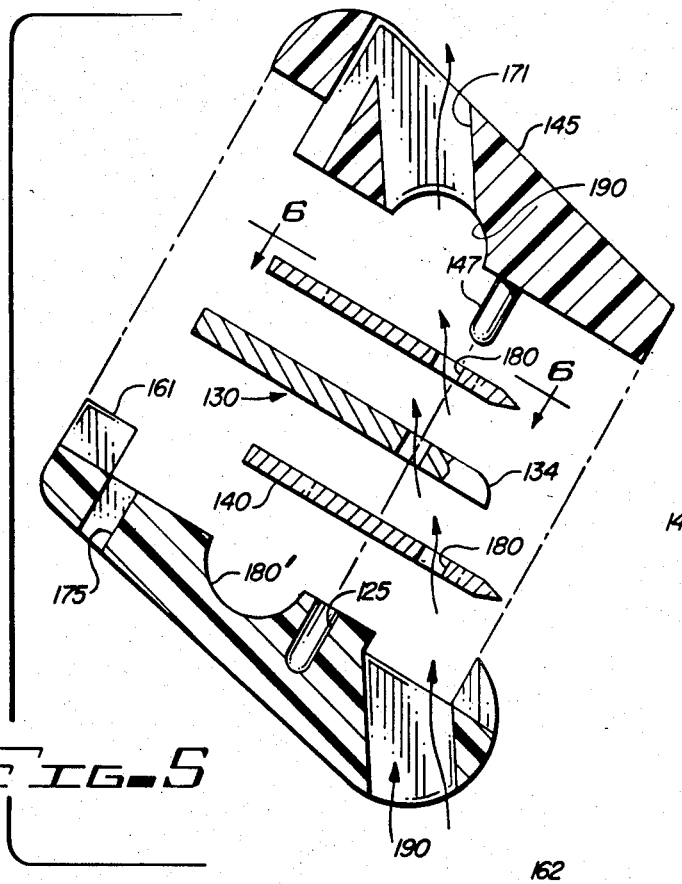
FIG. 5 is an exploded end view of an alternative assembly.
Figure 6:
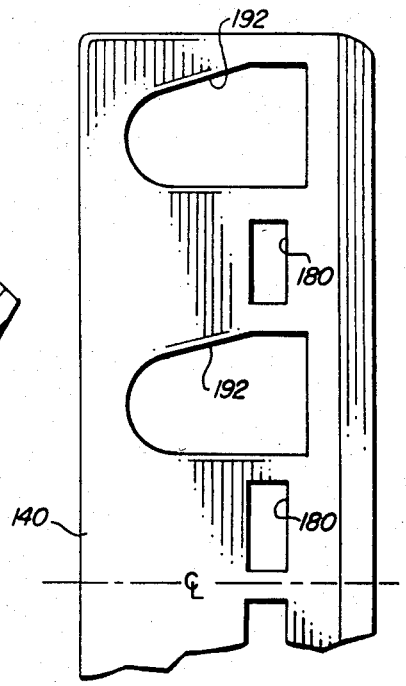
FIG. 6 shows the construction of a blade used in the assembly of FIGS. 5 and 6.
Figure 7:
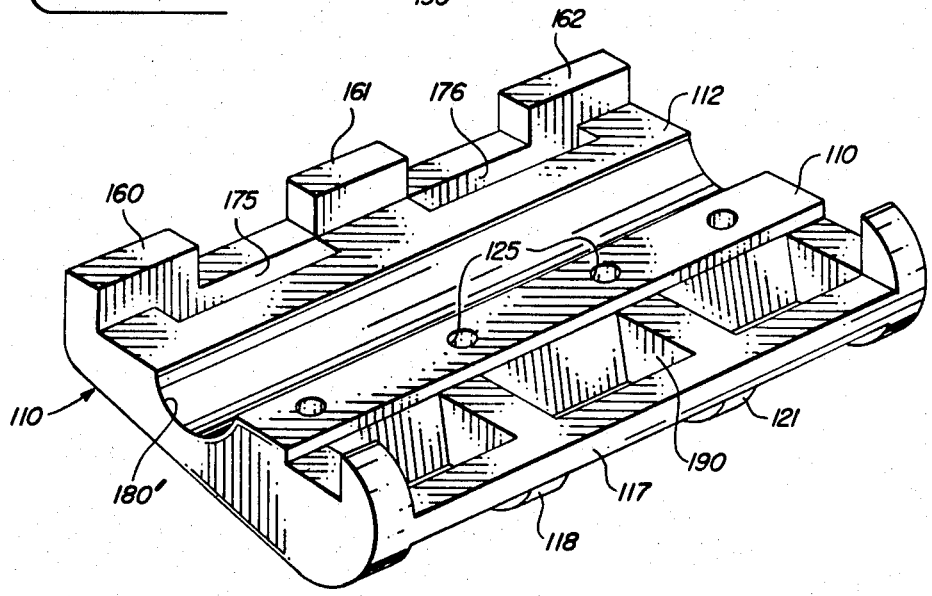
FIG. 7 is a perspective view of a base member used in the assembly of FIG. 5.

Reference now should be made to FIGS. 5, 6 and 7 which are directed to an alternate assembly which may be used in place of the one shown in FIGS. 1, 2 and 3. The assembly shown in FIGS. 5, 6 and 7 is similar to the one of FIGS. 1, 2 and 3 and the component parts of this alternative assembly which are similar to corresponding parts of the assembly of FIGS. 1, 2 and 3 are given the same reference number as a 100's series of numbers. For example, the cap 145 shown in FIG. 5 is comparable to the cap 45 shown in FIGS. 1 and 3. Similarly, the support pillars 60, 61 and 62 are represented by comparable support pillars 160, 161 and 162 in FIGS. 5 and 7. The assembly itself is comprised of the same number of parts as the assembly shown in FIGS. 1, 2 and 3, and is constructed in the same manner.

In the assembly shown in FIGS. 5 and 7, however, some modifications have been made in order to utilize a standard, commercially available blade 140 (FIG. 6) for both of the upper and lower blades of the dual blade assembly. In addition, the base member 110 and the cap member 145 are provided with modified slots or passageways 190 and 171, as shown most clearly in FIG. 5, to permit water to be flushed from beneath the guard member upwardly through flush holes 180 in the blade 140 and through corresponding portions of the mounting holes 192 between the teeth of the spacer 130 and upwardly through the modified slots 170, 171 and 173 in the cap 145. Conversely, water for flushing residue from between the blades and out of the holes 180 and 192 may be passed downwardly through the slots 170, 171, 172 and 173, through the holes in the blades 140 and between the fingers of the spacer 30 and, finally, outwardly through the slots 190 which space the guard bar 117 from the front edge of the main body portion of the base member 110.

The embodiment shown in FIGS. 5 and 7 also differs from the one illustrated in FIGS. 1 and 3 inasmuch as the depressions 80, 81, 90 and 91 of FIGS. 1 and 3 have been modified to semi-cylindrical slots 180 and 190 in the base member 110 and the cap 145, respectively. Consequently, water for rinsing residue from between the fingers of the spacer 130 may be passed directly through the assembly from end to end. This same modification also could be employed in the structure of the assembly of FIGS. 1 and 3, if desired. In all other respects, the embodiment shown in FIGS. 5 and 7, using the blade shown in FIG. 6, operates in the same manner as the embodiment described above in conjunction with FIGS. 1 through 4.

It should be noted in the foregoing discussion, that no specific details of the manner of attaching the cartridge to a handle have been given. This can be accomplished in a number of conventional ways, and the cartridge configuration for attachment to a handle preferably is a conventional one currently in use. Of course, the cartridge itself could be permanently bonded to a handle to create a complete disposable razor, if desired.

I claim:

1. A disposable razor blade cartridge unit including in combination:

a base member having a front wall and a rear wall, with a guard portion spaced outwardly from the front wall to define a slot and having a blade support surface thereon;

a first planar blade located on the support surface of said base member and having a cutting edge located above the slot and extending parallel to said guard portion;

a second planar blade having a cutting edge spaced upwardly and rearwardly of the cutting edge of said first blade;

an elongated spacer between said first and second blades and having a plurality of forwardly extending fingers connected to a spine member to define a plurality of forwardly open channels therebetween, said spine member being spaced rearwardly of at least one of said blades;

a cap member located on said second blade and interconnected with said base member for clamping together said first blade, said spacer, and said second blade between said cap member and said base member in a permanent non-moveable fixed relationship in the cartridge unit, said cap member and said base member having a plurality of aligned slots therethrough spaced rearwardly of the rear edge of said one of said blades and aligned with the channels between said fingers of said spacer at the ends of the channels where said fingers connect to said spine member to permit fluid flow therethrough in directions upwardly through the slots in said cap member and downward through the slots in said base member; and at least two spaced-apart support pillars on said base member adjacent the rear wall thereof between said base member and said cap member to form at least one exit port between said base member and said cap member in communication with the channels between said fingers of said spacer, whereby shaving residue accumulating between said first and second blades may be passed through the channels between said fingers and out of the unit through the slots in said cap member and the exit port, while said blades and said spacer are in an operative assembled relationship.

2. The combination according to claim 1 further including an opening in at least one of said base member and said cap member in each end thereof cooperating with the channels between said fingers of said spacer for permitting the passage of fluids therethrough to rinse shaving residue in said channels out of said cartridge.

3. The combination according to claim 1 where at least said base member and said cap member are made of molded plastic material and wherein said base member and said cap member are bonded together to form an integral razor blade unit.

4. The combination according to claim 1 further including means connecting with said base member and said cap member for aligning and maintaining a predetermined spacial relationship and position of said first blade, said spacer, and said second blade.

5. The combination according to claim 1 wherein said spine member is spaced rearwardly of both of said first and second blades; and further wherein said slots are in both said base member and said cap member parallel with the rear edge of said first and second blades and located rearwardly thereof to communicate with the channels between said fingers of said spacer for passing shaving residue in said channels out of said cartridge through said base member.

6. The combination according to claim 5 further including an opening in at least one of said base member and said cap member in each end thereof cooperating with the channels between said fingers of said spacer for permitting the passage of fluids therethrough to rinse shaving residue in said channels out of said cartridge.

7. The combination according to claim 6 further including means connecting said base member and said cap member for aligning and maintaining a predetermined spacial relationship and position of said first blade, said spacer, and said second blade.

8. The combination according to claim 7 where at least said base member and said cap member are made of molded plastic material and wherein said base member and said cap member are bonded together to form an integral razor blade unit.

9. A disposable razor blade cartridge unit including in combination;

a base member having a front wall and a rear wall, with a guard portion spaced outwardly from the front wall to define a slot and having a blade support surface thereon;

a first planar blade located on the support surface of said base member, having a cutting edge located above the slot, and extending parallel to said guard portion, said first planar blade further having residue flush holes passing therethrough and located above the slot between the guard portion and the blade support surface;

a second planar blade having a cutting edge spaced upwardly and rearwardly of the cutting edge of said first blade and having residue flush holes passing therethrough located to permit fluid to flow therethrough in communication with the residue flush holes of said first planar blade;

an elongated spacer between said first and second blades to maintain a predetermined space therebetween, said spacer having a plurality of forwardly extending fingers connected to a spine member to define a plurality of forwardly open channels between said fingers, said spine member being spaced rearwardly of at least one of said blades a cap member located on said second blade and interconnected with said base member for clamping together said first blade, said spacer, and said second blade between said cap member and said base member in a permanent non-moveable fixed relationship in the cartridge unit, said cap member having at least one slot through the top therein in alignment with a fluid flow path extending upwardly and downwardly through the flush holes in said first and second blades and the slot formed between the guard portion and the blade support surface of said base member to permit flushing fluid to pass through such path to remove residue accumulating between said first and second blades and accumulating in the holes through such blade, while said blades and said spacer means are in an operative assembled relationship; and at least two spaced-apart support pillars on said base member adjacent the rear wall thereof between said base member and said cap member to form at least one exit port between said base member and said cap member in communication with the channels between the fingers of said spacer, whereby shaving residue accumulating between said first and second blades may be passed through the channels between the fingers of said spacer and out of the unit through the slots in said cap member and the exit port.

* * * * *